US011116283B2

(12) United States Patent
Mokos et al.

(10) Patent No.: US 11,116,283 B2
(45) Date of Patent: Sep. 14, 2021

(54) SHOE HAVING CUSHION WITHIN HEEL MEMBER

(71) Applicant: Cole Haan LLC, New York, NY (US)

(72) Inventors: Jeffrey Mokos, New York, NY (US); Mattias Verfl, Manchester, NH (US); Scott Patt, New York, NY (US)

(73) Assignee: COLE HAAN LLC, Greenland, NH (US)

( * ) Notice: Subject to any disclaimer, the term of this patent is extended or adjusted under 35 U.S.C. 154(b) by 63 days.

(21) Appl. No.: 16/240,159

(22) Filed: Jan. 4, 2019

(65) Prior Publication Data

US 2019/0208858 A1 Jul. 11, 2019

Related U.S. Application Data

(60) Provisional application No. 62/614,433, filed on Jan. 7, 2018.

(51) Int. Cl.

| | |
|---|---|
| ***A43B 7/14*** | (2006.01) |
| ***A43B 13/18*** | (2006.01) |
| ***A43B 13/12*** | (2006.01) |
| ***A43B 17/14*** | (2006.01) |
| ***A43B 21/24*** | (2006.01) |

(52) U.S. Cl.

CPC ..... *A43B 7/144* (2013.01); *A43B 7/141* (2013.01); *A43B 7/145* (2013.01); *A43B 7/1445* (2013.01); *A43B 13/186* (2013.01); *A43B 7/1425* (2013.01); *A43B 13/12* (2013.01); *A43B 13/188* (2013.01); *A43B 17/14* (2013.01); *A43B 21/24* (2013.01)

(58) Field of Classification Search

CPC ..... A43B 7/144; A43B 7/141; A43B 7/1445; A43B 7/148; A43B 13/12; A43B 21/26

See application file for complete search history.

(56) References Cited

U.S. PATENT DOCUMENTS 4,001,955 A * 1/1977 Turner, Jr. ..... A43B 9/00 36/96
4,794,707 A * 1/1989 Franklin ..... A43B 7/14 36/107
5,435,078 A 7/1995 Pyle
(Continued)

FOREIGN PATENT DOCUMENTS

CA 2478749 A1 2/2006

*Primary Examiner* — Khoa D Huynh
*Assistant Examiner* — Erick I Lopez
(74) *Attorney, Agent, or Firm* — Thompson Coburn LLP

(57) ABSTRACT

A shoe includes a sole and an upper secured to the sole. The sole has a heel outsole member, a forefoot outsole member, a heel member, a chassis member, a heel cushion, a forefoot cushion, and a shank. The heel member extends downwardly from the chassis and the heel cushion is within an open top cavity in the heel member. The chassis member includes a through heel opening and a through forefoot opening with the heel opening overlying the open top heel cavity of the heel member. The heel cushion is in the heel opening of the chassis member. The forefoot cushion is in the forefoot opening of the chassis member. The shank has a through heel opening overlying the heel through opening in the chassis member. The heel outsole member is coupled to the heel member. The forefoot outsole member is in contact with the forefoot cushion.

19 Claims, 9 Drawing Sheets

(56) References Cited

U.S. PATENT DOCUMENTS

| | | | | |
|---|---|---|---|---|
| 7,380,353 | B2 * | 6/2008 | Feller | A43B 1/0072 36/108 |
| 2003/0172548 | A1 * | 9/2003 | Fuerst | A43B 13/026 36/28 |
| 2009/0193682 | A1 | 8/2009 | Rosenbaum | |
| 2017/0202303 | A1 | 7/2017 | Shepherd et al. | |

* cited by examiner

SHOE HAVING CUSHION WITHIN HEEL MEMBER

CROSS-REFERENCE TO RELATED APPLICATIONS

This application claims the benefit of U.S. Provisional Application No. 62/614,433, filed Jan. 7, 2018, the entirety of which is hereby incorporated by reference.

STATEMENT REGARDING FEDERALLY SPONSORED RESEARCH OR DEVELOPMENT

Not Applicable.

APPENDIX

Not Applicable.

BACKGROUND

Field

This disclosure pertains to shoes having heel members.

SUMMARY

One aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region, and a toe region. The heel region extends longitudinally from the sole heel end to the midfoot region, and the midfoot region extends longitudinally from the heel region to the ball region. The ball region extends longitudinally from the midfoot region to the toe region, and the toe region extends longitudinally from the ball region to the sole toe end. The sole has a heel outsole member, a forefoot outsole member, a heel member, a chassis member, a heel cushion, a forefoot cushion, and a shank. The chassis member extends from the sole heel end to the sole toe end. The heel member is in the heel region and extends downwardly from the chassis member, and the heel member includes a heel outer peripheral surface and an open top heel cavity. The heel cavity is spaced from the heel outer peripheral surface. The chassis member includes a through heel opening and a through forefoot opening with the heel opening overlying the open top heel cavity of the heel member and the forefoot opening being in at least the ball region. The heel cushion has a lower portion and an upper portion with the lower portion of the heel cushion being in the heel cavity and the upper portion of the heel cushion being in the heel opening of the chassis member. The forefoot cushion is in the forefoot opening of the chassis member. The shank extends toward the sole heel end and the sole toe end and has at least a heel portion and a midfoot portion. The shank further has a through heel opening in the heel portion, with the through heel opening of the shank overlying the heel through opening in the chassis member. The heel outsole member extends from the sole heel end to the sole midfoot region and has a top surface in contact with the heel member. The forefoot outsole member extends from the sole midfoot region to the sole toe end and has a top surface in contact with the forefoot cushion.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region, and a toe region. The heel region extends longitudinally from the sole heel end to the midfoot region, and the midfoot region extends longitudinally from the heel region to the ball region. The ball region extends longitudinally from the midfoot region to the toe region, and the toe region extends longitudinally from the ball region to the sole toe end. The sole has a heel member, a chassis member, a heel cushion, a forefoot cushion, and a shank. The chassis member extends from the sole heel end to the sole toe end. The heel member is in the heel region and extends downwardly from the chassis member. The heel member includes a heel outer peripheral surface and an open top heel cavity with the heel cavity being spaced from the heel outer peripheral surface. The chassis member includes a through heel opening and a through forefoot opening with the heel opening overlying the open top heel cavity of the heel member. The forefoot opening is in at least the ball region. The heel cushion has a lower portion and an upper portion with the lower portion of the heel cushion being in the heel cavity and the upper portion of the heel cushion being in the heel opening of the chassis member. The forefoot cushion is in the forefoot opening of the chassis member. The shank extends toward the sole heel end and the sole toe end and has at least a heel portion and a midfoot portion. The shank has a through heel opening in the heel portion with the through heel opening of the shank overlying the heel through opening in the chassis member.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region, and a toe region. The heel region extends longitudinally from the sole heel end to the midfoot region, and the midfoot region extends longitudinally from the heel region to the ball region. The ball region extends longitudinally from the midfoot region to the toe region, and the toe region extends longitudinally from the ball region to the sole toe end. The sole has a heel member, a chassis member, a heel cushion, a forefoot cushion, and a shank. The chassis member extends from the sole heel end to the sole toe end. The heel member is in the heel region and extends downwardly from the chassis member. The heel member includes a heel outer peripheral surface and an open top heel cavity with the heel cavity being spaced from the heel outer peripheral surface. The chassis member includes a through heel opening and a through forefoot opening with the heel opening overlying the open top heel cavity of the heel member. The forefoot opening is in at least the ball region. The heel cushion is in the heel cavity, and the forefoot cushion is in the forefoot opening of the chassis member. The shank extends toward the sole heel end and the sole toe end and has at least a heel portion and a midfoot portion. The shank has a through heel opening in the heel portion with the through heel opening of the shank overlying the heel through opening in the chassis member.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region, and a toe region. The heel region extends longitudinally from the sole heel end to the midfoot region, and the midfoot region extends longitudinally from the heel region to the ball region. The ball region extends longitudinally from the midfoot region to the toe region, and the toe region extends longitudinally from the ball region to the sole toe end. The sole has a heel member, a molded leather chassis member and a heel cushion. The molded leather chassis member extends from the sole heel end to the sole toe end. The heel member is in the heel region and extends downwardly from the molded leather chassis member. The heel member includes a heel outer peripheral surface and an open top heel cavity with the heel cavity being spaced from the heel outer peripheral surface. The molded leather chassis member includes a through heel opening overlying the open top heel cavity of the heel member, and the heel cushion is in the heel cavity.

Further features and advantages of the present disclosure, as well as the operation of the embodiments described herein, are described in detail below with reference to the accompanying drawings.

Figure 1:
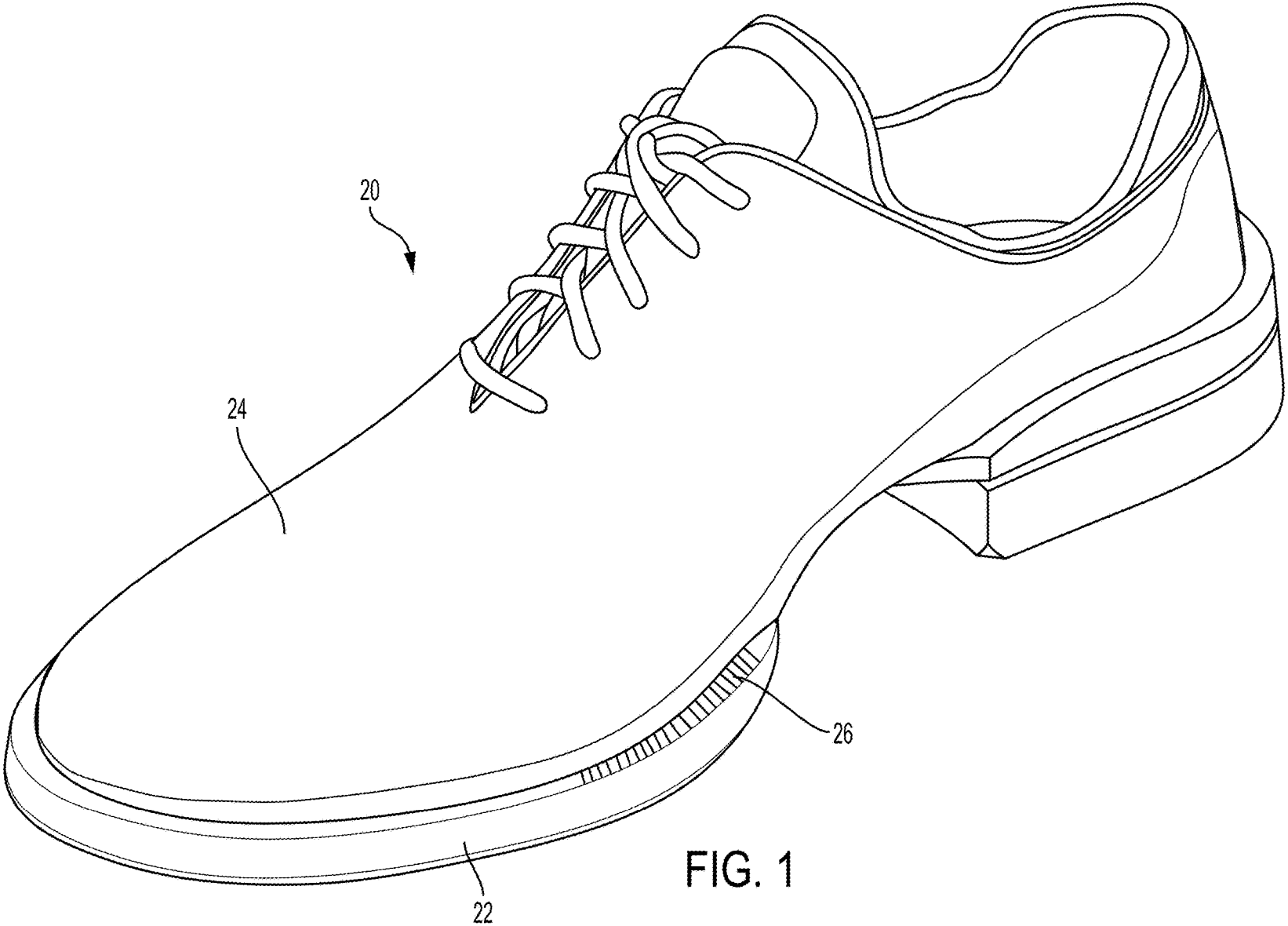
FIG. 1 is a perspective, schematic view of an embodiment of a shoe, the shoe including a sole, an upper, and a welt.

Reference numerals in the written specification and in the drawing figures indicate corresponding items.

DETAILED DESCRIPTION

An embodiment of a shoe in accordance with the present disclosure is indicated by reference numeral 20 in FIGS. 1-15. The shoe 20 comprises a sole, generally indicated at 22, an upper, generally indicated at 24, and a welt, generally indicated by 26. The welt 26 may be incorporated in a chassis member 28. The upper 24 is secured to the sole 22. The sole 22 has a chassis member 28, a heel member 30, a shank member 32, a heel cushion 34, a forefoot cushion 35, and a foot pad 36. The sole 22 extends longitudinally from a sole heel end 38 to a sole toe end 40 and extends transversely from a sole lateral edge 42 to a sole medial edge 44. The sole 22 includes a heel region 46, a midfoot region 48, a ball region 50, and a toe region 52. The heel region 46 extends longitudinally from the sole heel end 38 to the midfoot region 48. The midfoot region 48 extends longitudinally from the heel region 46 to the ball region 50. The ball region 50 extends longitudinally from the midfoot region 48 to the toe region 52. The toe region 52 extends longitudinally from the ball region 50 to the sole toe end 40. The welt 26 is secured to at least one of the sole 22 and the upper 24.

Figure 2:
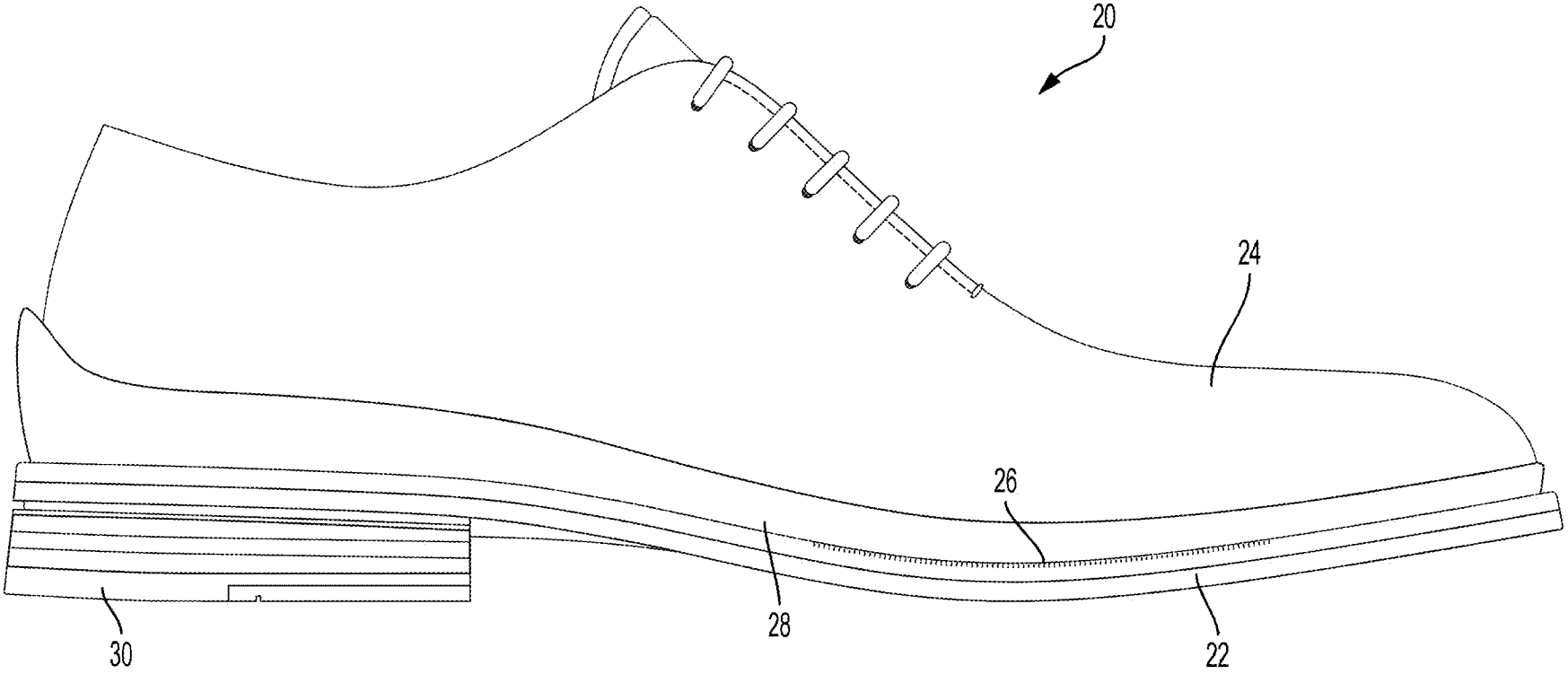
FIG. 2 is a detailed side view of the shoe shown in FIG. 1.
Figure 3:
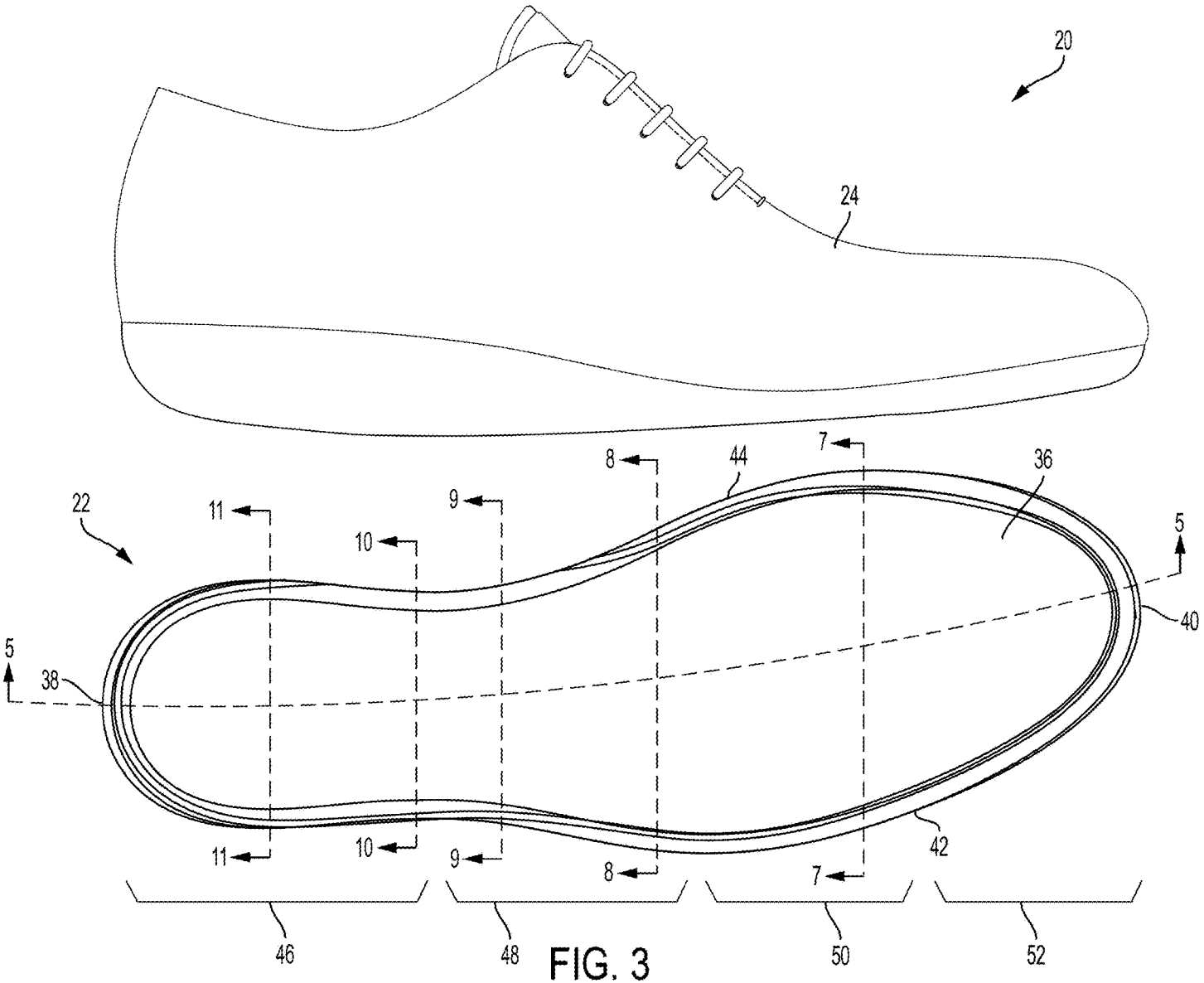
FIG. 3 is a top view of the sole of the shoe shown in FIG. 1.
Figure 4:
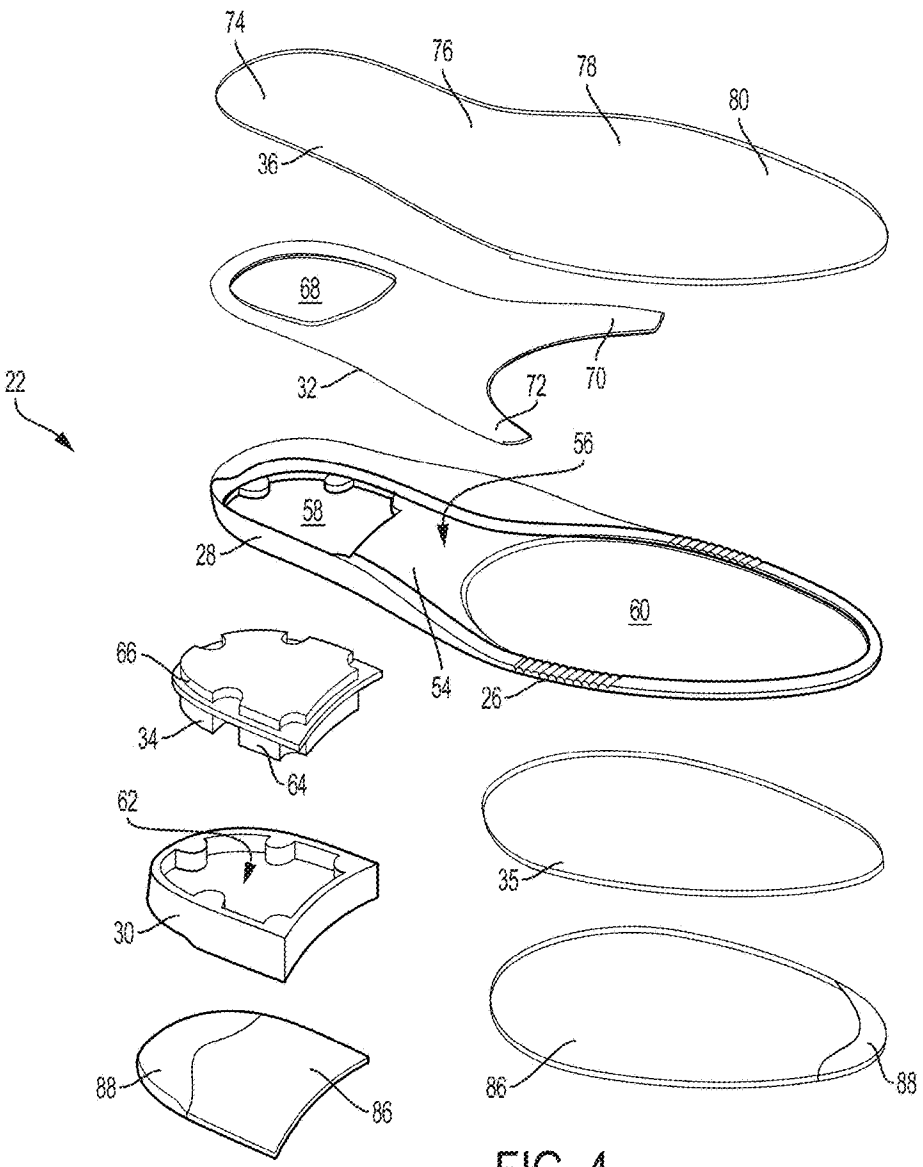
FIG. 4 is an exploded view of the shoe shown in FIG. 1 according to one embodiment.

In the embodiments of FIGS. 1-15, the chassis member 28 is of a molded leather construction. The molded leather construction of the chassis member 28 provides support to the heel and toe of the user and supplements the shank 32 in providing rigidity to the shoe 20. The cutouts in the chassis member 28 to accommodate the heel cushion 34 and forefoot cushion 35 decrease the rigidity of chassis member 28 in comparison to a solid chassis member. The decrease in rigidity facilitates flexing of the chassis member to accommodate movement of a user's foot. Specifically, the cutout for the forefoot 35 cushion increases flexibility of the chassis member 28 in the sole toe region 52 and the sole ball region 50, and, to a lesser extent, the cutout for the heel cushions 34 increases flexibility of the chassis member 28 in the sole heel region 46. The leather chassis 28 is formed from one or more leather bends with total thickness of between 3 and 5 millimeters, inclusive. The leather bend is planed to a uniform thickness and die cut to provide the outer perimeter of the chassis member, the cutout to accommodate the heel cushion 34, and the cutout to accommodate the forefoot cushion 35. The leather bend is machined (e.g., milled by a computer numerical control milling machine) to provide a tapered thickness from the center of the leather bend toward the perimeter of the leather bend. For example, and without limitation, the leather chassis may have a 3 millimeter thick portion extending between the sole heel end 38, the sole toe end 40, the sole lateral edge 42, and the sole medial edge 44. The leather chassis may have a 2 millimeter thick portion extending from the edges of the 3 millimeter thick portion, this 2 millimeter thick portion corresponding to the portion of the chassis member 28 that curves upward in the completed shoe 20 (e.g., as shown in FIG. 2). From the 2 millimeter thick portion, the leather bend tapers in thickness outward. After the leather bend has been machined to provide for the above described thicknesses, it is soaked in water, pressed, heated, and steamed on a mold (e.g., a last). After a predetermined amount of dwell time, the molded leather chassis 28 has taken the shape of the mold such that it has been formed to the shape depicted herein (e.g., as shown in FIG. 4).

The chassis member 28 extends from the sole heel end 38 to the sole toe end 40. The chassis member 28 includes a deck portion 54, a chassis member cavity 56, a through heel opening 58, and a through forefoot opening 60. The heel member 30 is in the heel region 46 and extends downwardly from the chassis member 28. The heel member 30 includes an open top heel cavity 62. The open top heel cavity 62 is sized to accommodate the heel cushion 34 such that the heel cushion 34 is positioned within the open top heel cavity 62 of the heel member 30. The heel cushion 34 has a lower portion 64 and an upper portion 66. The lower portion 64 is within the open top heel cavity 62 of the heel member 30.

The chassis member cavity 56 extends upwardly from the deck portion 54. The through heel opening 58 overlies the open top heel cavity 62. The through heel opening 58 is sized to accommodate the heel cushion 34. The upper portion 66 of the heel cushion is positioned in the through heel opening 58. The through forefoot opening 60 is sized to accommodate the forefoot cushion 35. For example, and without limitation, the through forefoot opening 60 is generally oval shaped and extends within and between the sole toe region 52, the sole ball region 50, and the sole midfoot region 48. The forefoot cushion 35 is positioned in the forefoot opening 60 of the chassis member 28. In some embodiments, the forefoot cushion 35 is generally oval shaped and corresponds to the forefoot opening 60 in the chassis member 28 (e.g., as shown in FIG. 4). In alternative embodiments, the forefoot cushion 35 and the forefoot opening 60 have alternative shapes such as a rounded rectangle, squared off oval, or other suitable shape.

The welt 26 of the chassis member 28 is adjacent the outer perimeter of at least a portion of the chassis member 28 and is incorporated in the chassis member 28. For example, and without limitation, the welt 26 is at least the ball region 50. In alternative embodiments, the welt 26 is separate from the chassis member 28, or the shoe 20 does not include a welt 26.

Figure 5:
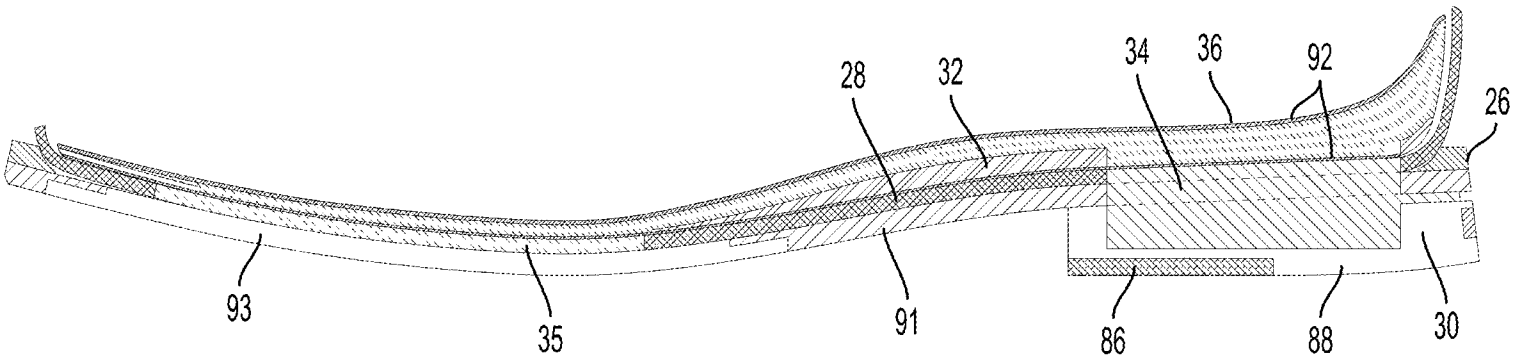
FIG. 5 is a cross-sectional view taken along the plane of line 5-5 of FIG. 3.
Figure 6:
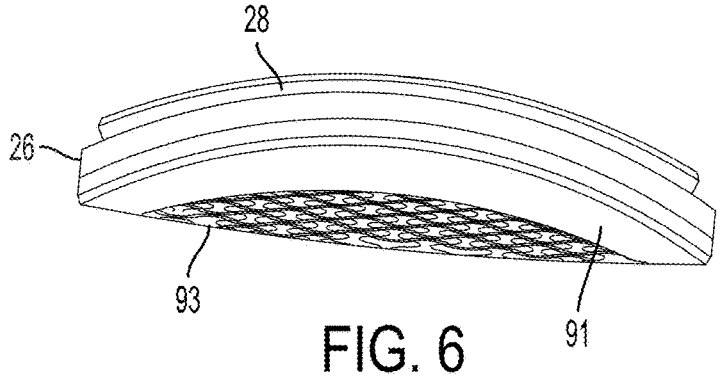
FIG. 6 is a front elevation view of the sole shown in FIG. 3.
Figure 7:
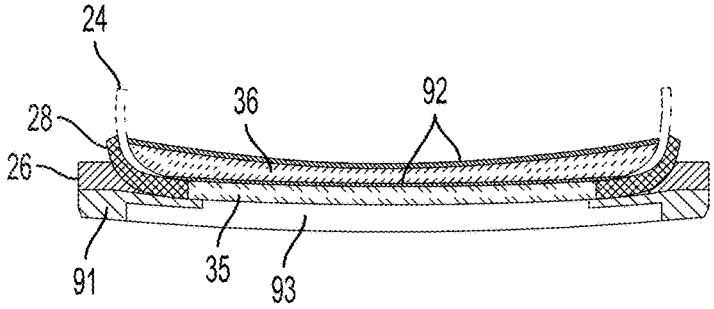
FIG. 7 is a cross-sectional view taken along the plane of line 7-7 of FIG. 3.
Figure 8:
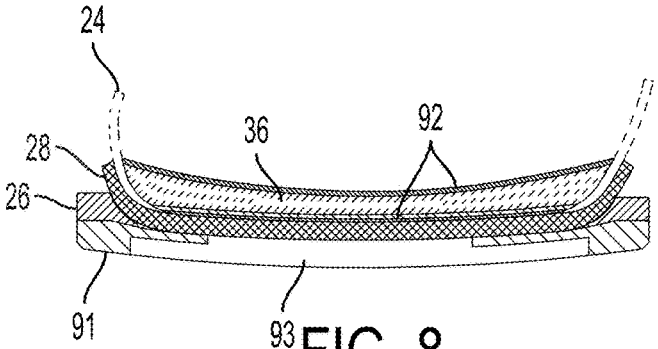
FIG. 8 is a cross-sectional view taken along the plane of line 8-8 of FIG. 3.
Figure 9:
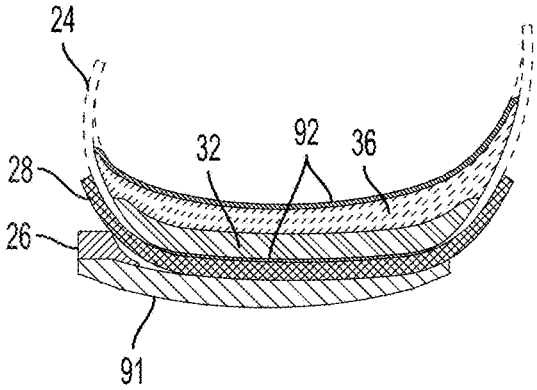
FIG. 9 is a cross-sectional view taken along the plane of line 9-9 of FIG. 3.
Figure 10:
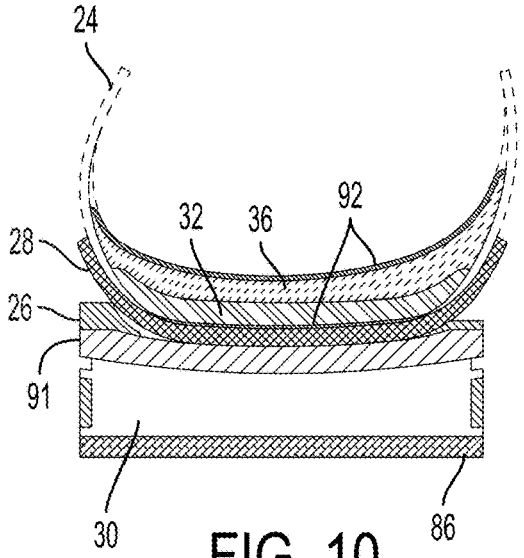
FIG. 10 is a cross-sectional view taken along the plane of line 10-10 of FIG. 3.
Figure 11:
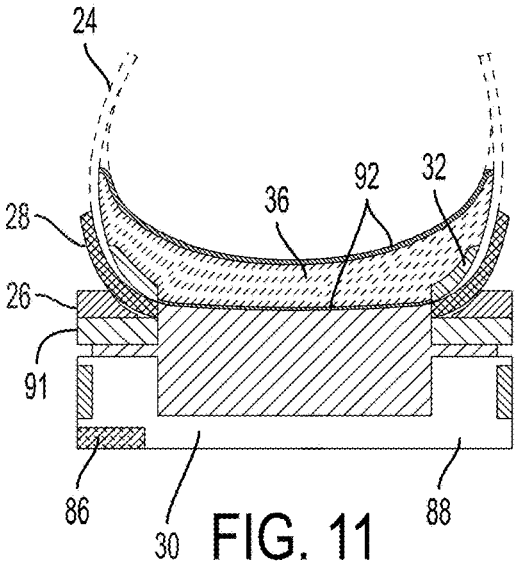
FIG. 11 is a cross-sectional view taken along the plane of line 11-11 of FIG. 3.
Figure 12:
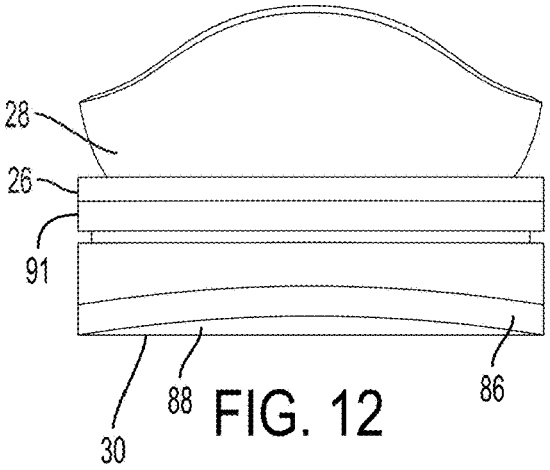
FIG. 12 is a rear elevation view of the sole shown in FIG. 3.
Figure 13:
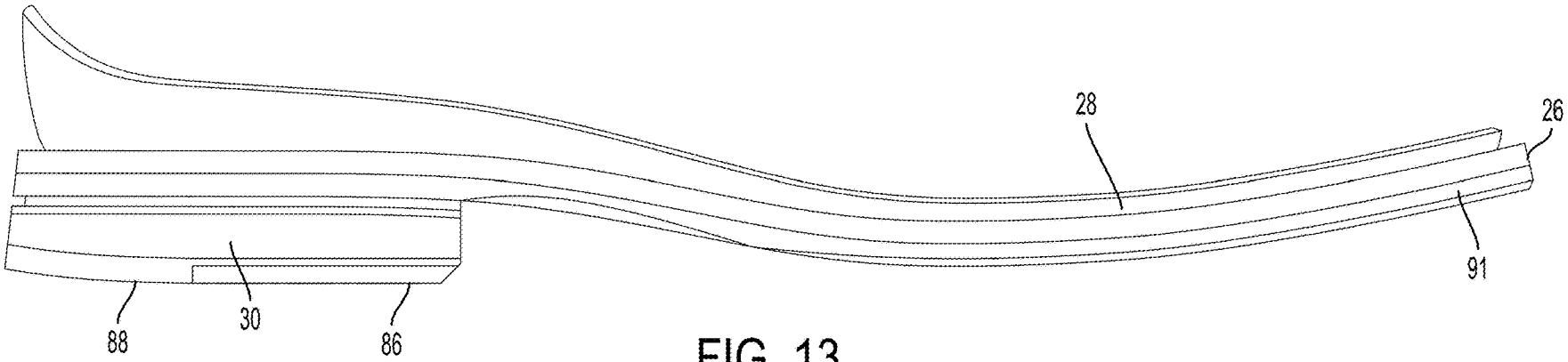
FIG. 13 is a lateral side elevation view of the sole shown in FIG. 3.
Figure 14:
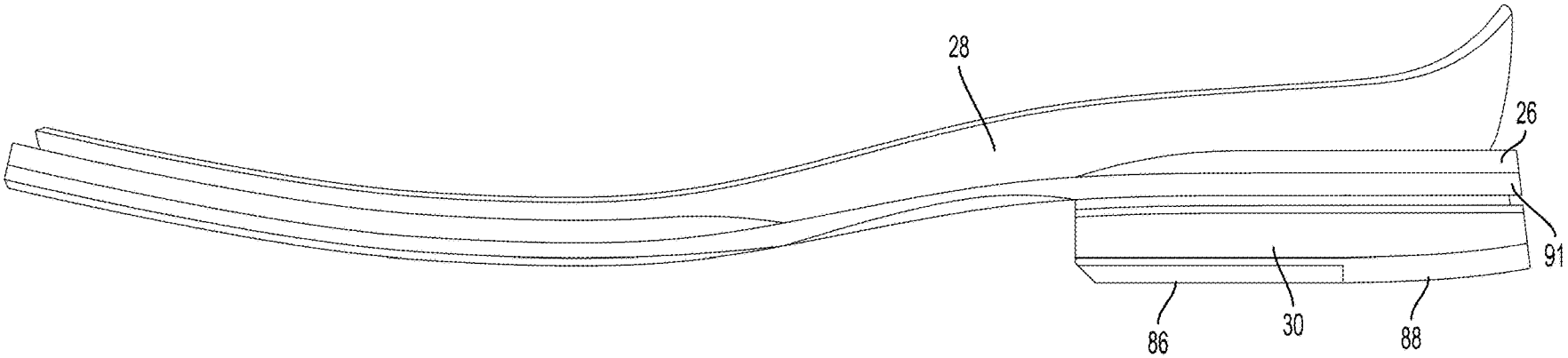
FIG. 14 is a medial side elevation view of the sole shown in FIG. 3.
Figure 15:
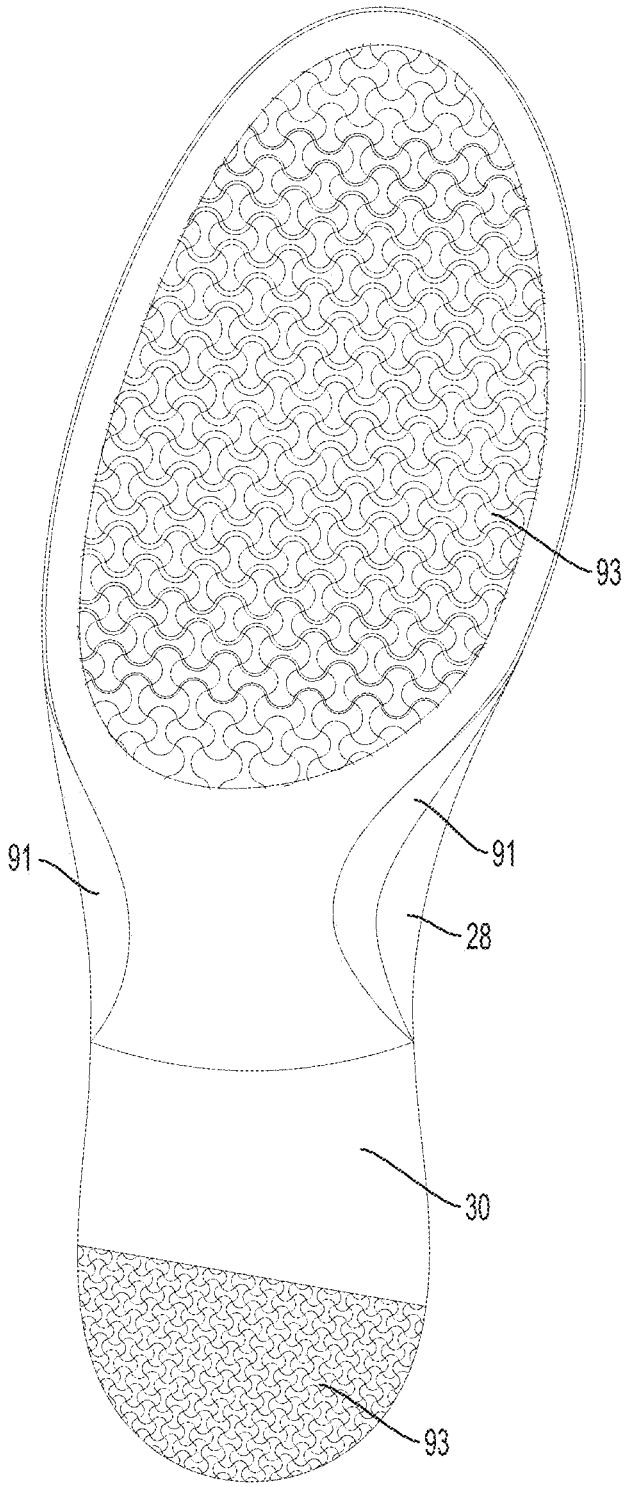
FIG. 15 is a bottom view of the sole shown in FIG. 3.

The shank 32 extends toward the sole heel end 38 and the sole toe end 40 and is in the heel region 46 and the midfoot region 48. The shank 32 includes a through heel opening 68. The through heel opening 68 overlies the heel through opening 58 in the chassis member 28. The through heel opening 68 may accommodate the upper portion 66 of the heel cushion 34 such that the heel cushion 34 is within the through heel opening 68 of the shank 32. For example, and without limitation, the heel cushion 34 may be flush with the top of the shank 32. In alternative embodiments, the upper portion 66 of the heel cushion 34 is not flush with the top of the shank 32 (e.g., the heel cushion 34 is partially within or not at all within the through heel opening 68 of the shank). In such embodiments (e.g., as shown in FIGS. 5 and 11), the foot pad 36 extends downwardly into the through heel opening 68 of the shank 32. The foot pad 36 is in contact with the heel cushion 34.

The shank 32 includes a medial side portion 70 and a lateral side portion 72. The medial side portion 70 extends from the midfoot region 48 toward the ball region 50 and from the sole medial edge 44 toward the sole lateral edge 42. The lateral side portion 72 extends from the midfoot region 48 toward the ball region 50 and from the sole lateral edge 42 toward the sole medial edge 44. The medial side portion 70 and the lateral side portion 72 are spaced apart in the direction extending between the medial and lateral sides. The medial side portion 70 and the lateral side portion 72 extend to the periphery of the forefoot through opening 60 of the chassis member 28. For example, and without limitation, the inboard side of the medial side portion 70 curves concavely toward the sole medial edge 44, and the inboard side of the lateral side portion 72 curves concavely toward the sole lateral edge 42.

The foot pad 36 extends between the sole heel 38 and the sole toe end 40. The foot pad includes a heel portion 74, a midfoot portion 76, a ball portion 78, and a toe portion 80. The heel portion 74 of the foot pad 36 is positioned such that it extends downwardly into the heel through opening 68 of the shank 32 and is in contact with the heel cushion 34. The heel portion 74 and at least a portion of the midfoot portion 76 are thinner than the remainder of the foot pad 36 to accommodate the shank 32. At least a portion of the midfoot portion 76, the ball portion 78, and the toe portion 80 are thicker by an amount equal to the thickness of the shank 32. In alternative embodiments, the foot pad 36 has alternative configurations. For example, and without limitation, the foot pad 36 may be of a constant thickness.

Different components of the sole 22 are constructed of different materials and may be of different hardness. The configuration of these components, their material construction, and their varying hardness cooperate to increase the comfort of the shoe 20 when worn. The shank 32 is harder than the chassis member 28, the chassis member 28 is harder than both the heel cushion 34 and the forefoot cushion 35, and the heel member 30 is harder than the heel cushion 34. In the embodiments of FIGS. 1-15, the heel member 30 is of a molded construction and is a one-piece member separate from the chassis member 28. The heel member 30 is constructed of a material such as a thermoplastic polyurethane having a durometer hardness in a range of 70 to 75 on a Shore A hardness scale. The chassis member 28 is constructed of a molded leather of type described herein, and the shank 32 is constructed of a material such as polypropylene. The shank 32 has a hardness of between 75 and 85, inclusive, on a Shore D scale. The heel cushion 34 is constructed of a material such as polyurethane (foamed or un-foamed) having a hardness of between 40 and 45, inclusive, on a Shore A scale. The forefoot cushion 35 is constructed of a material such as ethylene-vinyl acetate (foamed or un-foamed) and has a hardness of between 25 and 35, inclusive, on a Shore C scale. In alternative embodiments, these components may be constructive of different materials and/or be of different hardness. For example, and without limitation, the shank 32 may be made of a metal such as steel, the chassis member 28 may be a plastic (with or without a leather veneer), and/or the heel cushion 34 and forefoot cushion 35 may be one or more of ethylene-vinyl acetate foam, polyurethane, and polypropylene. The sole 22 may be constructed or any combination of materials (described herein or otherwise) such that the components have the relative hardness described herein.

In the embodiments of FIGS. 1-15, the shank 32 is more rigid than the chassis member 28, and the chassis member 28 is more rigid than both the heel cushion 34 and the forefoot cushion 35. Rigidity may be a function of the geometry of the components and/or the hardness of the materials of which each component is constructed. The rigidity of the components alone and in combination with the hardness of each component increase the comfort of the shoe 20. For example, and without limitation, the hardness and rigidity of the molded leather chassis 28 allow the shank 32 to be constructed or a less rigid and hard material than if the shoe 20 did not include the molded leather chassis 28 (e.g., in a typical shoe the shank may be made of steel rather than polypropylene).

In some embodiments, the sole 22 further includes a heel outsole member 82 and a forefoot outsole member 84. Each of the heel outsole member 82 and the forefoot outsole member 84 include a first portion 86 constructed of a first material and a second portion 88 constructed of a second material. For example, and without limitation, the first portion 86 is constructed of leather and the second portion 88 is constructed of a rubber or rubber like plastic. In some embodiments, the second portion 88 of the heel outsole member 82 is constructed of the same material as the heel member 30. In some embodiments, the sole 22 further includes a midfoot outsole member 90. The midfoot outsole member 90 may be leather or another suitable material, may be the same material as the second portion 88, and may extend beyond the midfoot region 48 (e.g., as shown in FIG. 5-12). For example, the sole includes an outsole 91, which may be constructed of leather, and that extends from the sole toe end 40 to the sole heel end 38 and is coupled to the welt 26 and/or the chassis member 28. The heel member 30 is coupled to the outsole 91 and the heel cushion 34 extends through the outsole 91. The outsole 91 may include a second portion 93 of another material, tread pattern, or the like. In alternative embodiments, the sole 22 does not include a midfoot outsole member 90 and the molded leather chassis 28 is visible and is the outer surface of the sole midfoot region 48 (e.g., as shown in FIG. 4).

In some embodiments, the shank 32 and the footpad 36 are contained within a sleeve 92. For example, and without limitation, the sleeve 92 may be a woven material, fabric material (synthetic or natural), plastic, polymer, or the like. In alternative embodiments, the shank 32 is in direct contact with the foot pad 36 and the chassis member 28, and the foot pad 36 is at least partially in direct contact with the chassis member 28 (e.g., in the midfoot region 48, ball region 50, and/or toe region 52).

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements of the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region, the ball region extending longitudinally from the midfoot region to the toe region, and the toe region extending longitudinally from the ball region to the sole toe end, the sole having a heel outsole member, a forefoot outsole member, a heel member, a chassis member, a heel cushion, a forefoot cushion, and a shank, the chassis member extending from the sole heel end to the sole toe end, the heel member being in the heel region and extending downwardly from the chassis member, the heel member including a heel outer peripheral surface and an open top heel cavity, the open top heel cavity being spaced from the heel outer peripheral surface, the chassis member including a through heel opening and a through forefoot opening, the through heel opening overlying the open top heel cavity of the heel member, the through forefoot opening being in at least the ball region, the heel cushion having a lower portion and an upper portion, the lower portion of the heel cushion being in the open top heel cavity and the upper portion of the heel cushion being in the through heel opening of the chassis member, the forefoot cushion being in the through forefoot opening of the chassis member, the shank extending toward the sole heel end and the sole toe end and having at least a heel portion and a midfoot portion, the shank having a through heel opening in the heel portion, the through heel opening of the shank overlying the heel through opening in the chassis member, the heel outsole member extending from the sole heel end to the sole midfoot region, the heel outsole member having a top surface in contact with the heel member, the forefoot outsole member extending from the sole midfoot region to the sole toe end, the forefoot outsole member having a top surface in contact with the forefoot cushion.

2. A shoe as set forth in claim 1, wherein the chassis member has a bottom surface and a top surface, the heel cushion being flush with the top surface of the chassis member about the through heel opening of the chassis member.

3. A shoe as set forth in claim 1, wherein the heel cushion extends through the through heel opening of the chassis member and beyond at least a portion of the chassis member.

4. A shoe as set forth in claim 3, wherein the through heel opening of the shank overlies the through heel opening of the chassis member, the heel cushion being in the shank heel opening.

5. A shoe as set forth in claim 1, further comprising a foot pad, the foot pad extending between the sole heel end and the sole toe end, the foot pad having a heel portion, a midfoot portion, and a ball portion, wherein the through heel opening of the shank overlies the through heel opening of the chassis member, the heel portion of the foot pad being in the through heel opening of the shank and being in contact with the heel cushion.

6. A shoe as set forth in claim 1, the forefoot cushion being in at least two of the ball region, the toe region, and the midfoot region.

7. A shoe as set forth in claim 1, wherein the shank includes a medial side portion and a lateral side portion, the medial side portion extending from the midfoot region toward the ball region and from the sole medial edge toward the sole lateral edge, the lateral side portion extending from the midfoot region toward the ball region and from the sole lateral edge toward the sole medial edge, the medial side portion and the lateral side portion being spaced apart in the direction extending between the medial and lateral sides.

8. A shoe as set forth in claim 1, wherein the chassis member includes a periphery, the through forefoot opening being spaced from the periphery of the chassis member.

9. A shoe as set forth in claim 1, wherein the chassis member is at least partially leather, the heel cushion is at least one of ethylene-vinyl acetate foam, polyurethane, and polypropylene, and the forefoot cushion is at least one of ethylene-vinyl acetate foam, polyurethane, and polypropylene.

10. A shoe as set forth in claim 1, wherein the shank has a hardness of between 75 and 85, inclusive, on a Shore D scale, the heel cushion has a hardness of between 40 and 45, inclusive, on a Shore A scale, and the forefoot cushion has a hardness of between 25 and 35, inclusive, on a Shore C scale.

11. A shoe as set forth in claim 1, wherein the shank is more rigid than the chassis member, and the chassis member is more rigid than both the heel cushion and the forefoot cushion.

12. A shoe as set forth in claim 1, wherein the shank is harder than the chassis, the chassis is harder than both the heel cushion and the forefoot cushion, and the heel member is harder than the heel cushion.

13. A shoe as set forth in claim 1, wherein the chassis member includes a deck portion and a wall portion, the deck portion extending to the sole heel end, the sole toe end, the sole medial edge, and the sole lateral edge, the wall portion extending upward from the deck portion in the heel region and the midfoot region, the wall portion tapering to the deck portion in the ball region.

14. A shoe as set forth in claim 13, wherein the wall portion of the chassis member curves as the wall portion meets the deck portion.

15. A shoe as set forth in claim 1, wherein the chassis member is visible as viewed in a bottom view of the shoe.

16. A shoe as set forth in claim 15, wherein the chassis member is visible as viewed in a lateral side elevational view of the shoe, and wherein the chassis member is visible as viewed in a medial side elevation view of the shoe.

17. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region, the ball region extending longitudinally from the midfoot region to the toe region, and the toe region extending longitudinally from the ball region to the sole toe end, the sole having a heel member, a chassis member, a heel cushion, a forefoot cushion, and a shank, the chassis member extending from the sole heel end to the sole toe end, the heel member being in the heel region and extending downwardly from the chassis member, the heel member including a heel outer peripheral surface and an open top heel cavity, the open top heel cavity being spaced from the heel outer peripheral surface, the chassis member including a through heel opening, a through forefoot opening, and a periphery, the through forefoot opening being spaced from the periphery of the chassis member, the through heel opening overlying the open top heel cavity of the heel member, the through forefoot opening being in at least the ball region, the heel cushion having a lower portion and an upper portion, the lower portion of the heel cushion being in the open top heel cavity and the upper portion of the heel cushion being in the through heel opening of the chassis member, the forefoot cushion being in the through forefoot opening of the chassis member, the shank extending toward the sole heel end and the sole toe end and having at least a heel portion and a midfoot portion, the shank having a through heel opening in the heel portion, the through heel opening of the shank overlying the heel through opening in the chassis member.

18. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region, the ball region extending longitudinally from the midfoot region to the toe region, and the toe region extending longitudinally from the ball region to the sole toe end, the sole having a heel member, a chassis member, a heel cushion, a forefoot cushion, and a shank, the chassis member extending from the sole heel end to the sole toe end, the heel member being in the heel region and extending downwardly from the chassis member, the heel member including a heel outer peripheral surface and an open top heel cavity, the open top heel cavity being spaced from the heel outer peripheral surface, the chassis member including a through heel opening, a through forefoot opening, and a periphery, the through forefoot opening being spaced from the periphery of the chassis member, the through heel opening overlying the open top heel cavity of the heel member, the through forefoot opening being in at least the ball region, the heel cushion being in the open top heel cavity, the forefoot cushion being in the through forefoot opening of the chassis member, the shank extending toward the sole heel end and the sole toe end and having at least a heel portion and a midfoot portion, the shank having a through heel opening in the heel portion, the through heel opening of the shank overlying the heel through opening in the chassis member.

19. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region, the ball region extending longitudinally from the midfoot region to the toe region, and the toe region extending longitudinally from the ball region to the sole toe end, the sole having a heel member, a molded leather chassis member and a heel cushion, the molded leather chassis member extending from the sole heel end to the sole toe end, the molded leather chassis member including a periphery, the heel member being in the heel region and extending downwardly from the molded leather chassis member, the heel member including a heel outer peripheral surface and an open top heel cavity, the open top heel cavity being spaced from the heel outer peripheral surface, the molded leather chassis member including a through heel opening overlying the open top heel cavity of the heel member, the molded leather chassis member including a through forefoot opening in at least the ball region, the through forefoot opening being spaced from the periphery of the molded leather chassis member, the heel cushion being in the open top heel cavity.

* * * * *